United States Patent [19]

Sabat

[11] 4,132,408

[45] Jan. 2, 1979

[54] WEAPON

[76] Inventor: Jack M. Sabat, 233 Surrey La., Clarkston, Mich. 48016

[21] Appl. No.: 742,668

[22] Filed: Nov. 17, 1976

[51] Int. Cl.[2] ..... F41B 15/02

[52] U.S. Cl. ..... 273/84 R

[58] Field of Search ..... 273/68, 67 R, 80 R, 273/80 D, 80.1, 81.2, 84 R; 272/75; 135/15 PQ, 74–76; 403/349

[56] References Cited

U.S. PATENT DOCUMENTS

| | | | |
|---|---|---|---|
| 1,443,121 | 1/1923 | Fogg | 135/76 X |
| 2,194,386 | 3/1940 | Dunaway | 273/80 R X |
| 3,368,271 | 2/1968 | Scheffler | 273/68 X |
| 3,439,928 | 4/1969 | Noguchi | 273/80.1 X |
| 3,448,748 | 6/1969 | Walrave | 135/15 PQ X |
| 3,596,946 | 8/1971 | Burton et al. | 273/80 D X |
| 3,730,544 | 5/1973 | Hyman | 135/15 PQ X |
| 3,963,037 | 6/1976 | Clark | 135/15 PQ X |
| 4,007,931 | 2/1977 | Wich et al. | 273/84 R |

FOREIGN PATENT DOCUMENTS

| | | | |
|---|---|---|---|
| 1301413 | 7/1962 | France | 135/15 PQ |

*Primary Examiner*—Richard J. Apley
*Attorney, Agent, or Firm*—Gifford, Chandler, VanOphem, Sheridan & Sprinkle

[57] ABSTRACT

A novel weapon is provided in the form of a combination riot or night stick and nunchaku. The weapon comprises a first and second elongated member. One axial end of the first member is connected to one axial end of the second member by a flexible cable. In addition each member includes a coupling at its end with the flexible cable so that the first and second members can be rigidly, but detachably, secured coaxially together. With the first and second members secured together by the couplings. the weapon can be used as a night stick or riot stick. Conversely, with the couplings disconnected from each other so that the first and second members are joined only by the flexible cable, the weapon can be used as a nunchaku.

8 Claims, 8 Drawing Figures

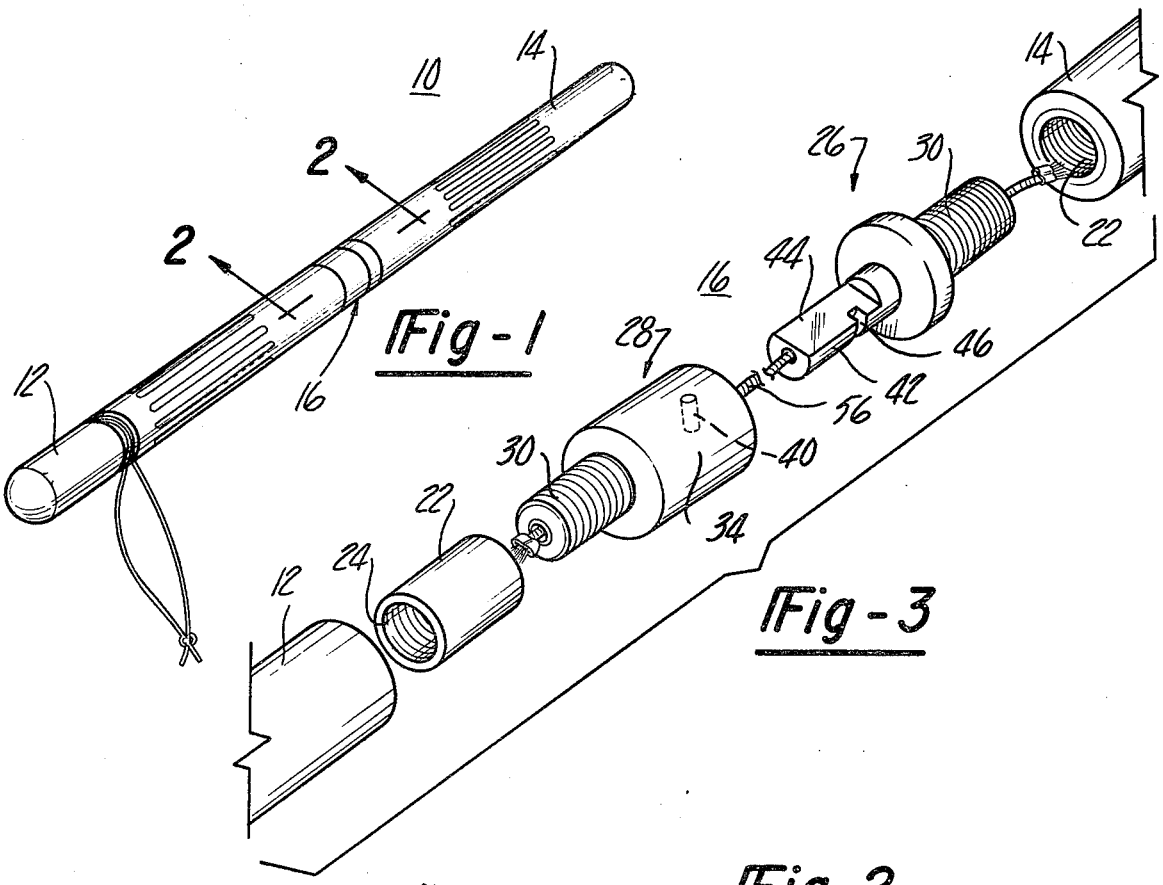
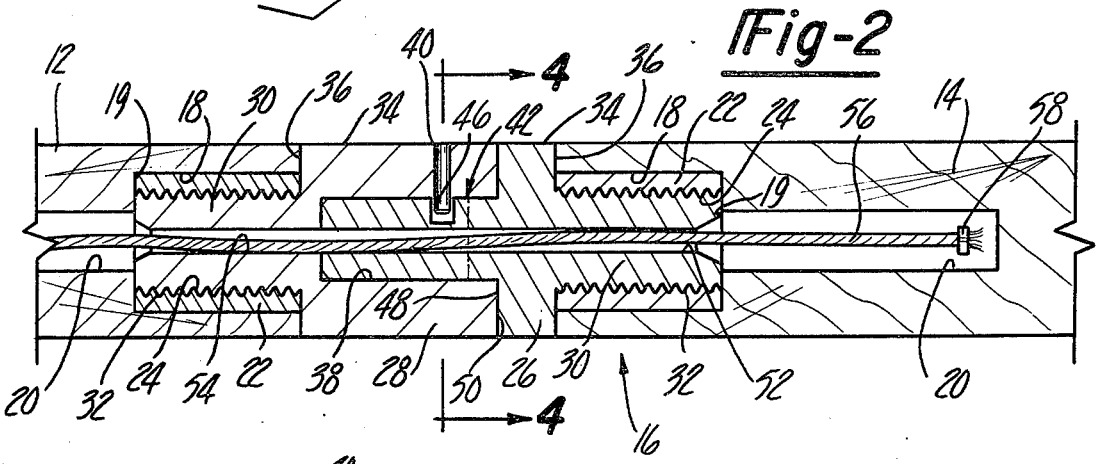
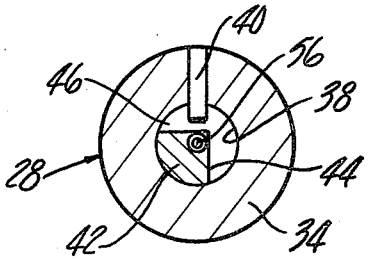
Fig-4

WEAPON

BACKGROUND OF THE INVENTION

I. Field of the Inventio

The present invention relates generally to hand held weapons, and more particularly, to a combination night or riot stick and nunchaku.

I. Description of the Prior Art

There are many types of hand held weapons which are used, for example, by policeman and other law enforcement officers. One such weapon is a night or riot stick which is generally cylindrical and elongated in shape and constructed of a relatively hard material. A riot stick is somewhat longer than a night stick and is used for crowd control situations where additional protection of the law enforcement officer is desired.

A nunchaku is another type of hand held weapon which originated from the Far East. The nunchaku typically comprises a first and second rod-like members which are axially joined at one end by a flexible element, such as a cord or a chain. The nunchaku is an effective and potentially dangerous weapon particularly when used by persons knowledgeable in the martial arts, such as karate.

Previously it has been the practice for law enforcement officers and others, to carry a number of different hand held weapons as desired or required. Consequently, a policemen will often carry both a night stick and a nunchaku in readiness for all possible attack or defense situations. Other law enforcement officers, however, carry only a night stick and omit the nunchaku. This latter practice is disadvantageous in that the law enforcement officer effectively reduces his self defense arsenal and exposes himself to situations with which a nunchaku would deal more effectively than just a night stick.

SUMMARY OF THE PRESENT INVENTION

The weapon of the present invention overcomes the above mentioned disadvantages of the previously known night or riot sticks and nunchakus by providing a combination riot or night stick and nunchaku weapon.

In brief the weapon of the present invention comprises a first and second elongated member, preferably constructed of a hard woood or hard plastic. The first axial ends of the members are joined together by means of a flexible element such as a cable or a chain. In addition each member includes a coupling at its first end so that the first and second members can be rigidly, but detachably, coaxially secured together by the couplings.

With the first and second members secured coaxially together by the couplings, the weapon of the present invention can be used as a night or riot stick depending upon the overall axial length of the weapon. Moreover, for ease of description only, the term night stick will hereinafter collectively refer to both a night stick and a riot stick.

Conversely, with the couplins detached from each other, the members are connected together only be the flexible element. With this arrangement the weapon of the present invention forms a nunchaku. When use of the nunchaku is no longer required, the elongated members can be easily and rapidly connected axially together by the coupling, so that the weapon again forms a night stick.

As will be hereinafter described in greater detail, the weapon of the present invention provides a novel combination night stick and nunchaku hand held weapon.

BRIEF DESCRIPTION OF THE DRAWINGS

A better understanding of the present invention will be had upon reference to the following detailed description when read in conjunction with the accompanying drawing, wherein like reference characters refer to like parts throughout the several views, and in which:

FIG. 1 is a perspective view illustrating the weapon of the present invention as a night stick;

FIG. 2 is a fragmentary cross sectional view taken substantially along line 2—2 in FIG. 1;

FIG. 3 is a fragmentary exploded perspective view showing one portion of the weapon of the present invention;

FIG. 4 is a sectional view taken substantially along line 4—4 in FIG. 2;

DETAILED DESCRIPTION OF THE PRESENT INVENTION

Figure 5:
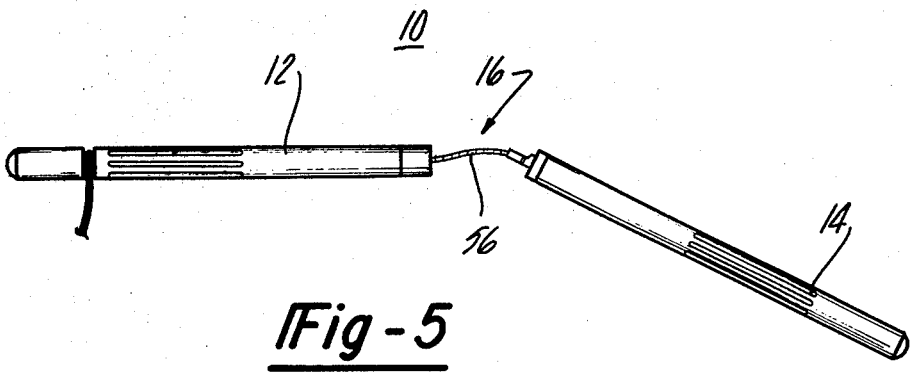
FIG. 5 is a plan view illustrating the weapon of the present invention as a nunchaku.

With reference first to FIGS. 1 and 5, the weapon 10 of the present invention is there shown and comprises a first and second handle member 12 and 14, respectively. The handle members 12 and 14 can be coaxially joined together at their inner axial ends by a coupling 16 which will subsequently be described in greater detail. The handle members 12 and 14 are substantially identical to each other and are elongated and generally cylindrical or polygonal in shape. Typically the handle members 12 and 14 are constructed of a hardwood, such as rose wood, but alternatively, could be of constructed of a hard plastic or other suitable material.

With reference now to FIGS. 2–4, the coupling 16 for securing the handle members 12 and 14 axially together is thereshown in greater detail. Each of the handle members 12 and 14 includes a cylindrical recess 18 formed in their respective inner axial end and preferably a smaller diameter recess extends axially inwardly from the base 19 of the recess 18 for a relatively short distance.

A cylindrical sleeve 22 having inner threads 24 is positioned within each of the recesses 18 in the members 12 and 14. The threaded sleeve 22 is rigidly and preferably permanently secured within the recess 18 by any appropriate means, such as glue.

The coupling 16 further cmprises a male portion 26 and a female portion 28. Each of the portions 26 and 28 includes a cylindrical shank 30 having external threads 32 for threadably engaging the inner threads 24 of one of the sleeves 22. Consequently both the male portion 26 and the female portion 28 can be axially screwed into and attached to either of the handle members 12 or 14. However, as shown in the drawing, the female portion 28 is axially attached to the handle member 12 while the male portion 26 is attached to the member 14.

Both the male and female portions 26 and 28 include an enlarged head 34 which forms an annular abutment surface 36 between the enlarged head 34 and the threaded shank 30. The annular abutment surface 36 abuts against the axial end of its respective handle member 12 or 14 and limits the inward travel of the respective portions 26 and 28. In addition the diameter of the enlarged head 34 is preferably substantially the same as the handle members 12 and 14 so that the outer periphery of the coupling 16 is flush with the handle members 12 and 14.

An axial and preferably cylindrical recess 38 is formed within the enlarged head 34 of the female portion 28 and a radial pin 40 extends inwardly into the recess 38. The axial recess 38 in the female portion 28 is adapted to receive an axial locking shank 42 on the male portion 26. The locking shank 42 is generally cylindrical in shape but also includes an axial flat 44 (FIG. 3) and a circumferential slot 46 near its base.

The depth of the flat 44 is greater than the radial projection of the pin 40 into the recess 38 so that the locking shank 42 can be inserted into the recess 38 with the pin 40 riding above the surface of the flat 44. With the outwardly facing annular surfaces 48 and 50 of the male portion 26 and female portion 28, respectively, abutting together as shown in FIG. 2, the pin 40 registers with the circumferential slot 46. Thus rotation of either of te handle members 12 or 14 relative to the other positions the pin 40 within the circumferential slot 46 and effectively locks the handle members 12 and 14 axially together. Conversely, reverse rotation of the handle members relative to the other again repositions the pin 40 above the flat 44 on the locking shank 42 and permits detachment of the male portion 26 from th female portin 28. In addition the circumferential slot 46 preferably curves axially inwardly along it length and functions as a cam in conjunction with the pin 40 to urge the handle members 12 and 14 axially together upon a locking rotation of the handle members.

The male portion 26 includes an axial through bore 52 which registers with a like axial through bore 54 in the female portion 28. An elongated flexible member 56, such as a plastic coated wire cable, is disposed through the registering axial bores 52 and 54 and extends into the cylindrical recess 20 in one or both of the handle members 12 and 14. Retainer means 58, such as a clip having a larger diameter than the through bores 52 and 54, is secured to each end of the flexible element 56. The retainer means 58 effectively prevents removal of the flexible element 56 from the coupling 16.

In operation the handle members 12 and 14 can be rigidly, but detachably, coaxially secured together by the coupling 16 in the already described manner. With the handle members 12 and 14 axially coupled together, a night stick, such as shown in FIG. 1, is obtained.

Upon separating the male portion 26 from the female portion 28 of the coupling 16, the handle members 12 and 14 ae separated from each other so that the inner axial ends of the handle members 12 and 14 are joined together only by means of the flexible element 56. With the coupling 16 disconnected, as shown in FIG. 5, the weapon 10 of the present invention forms a nunchaku. Upon reattachment of the male and female portions 26 and 28, respectively, of the coupling 16 the weapon 10 of the present invention again forms the night stick shown in FIG. 1.

Although the male and female portions 26 and 28 can be peramanently secured to the handle members, the threaded engagement between the male and female portions 26 ad 28 and their respective sleeves 18 within the handle members 12 and 14 is preferred. This threaded engagement permits detachment of the coupling 16 from the handle members 12 and 14 which in turn permits replacement of the flexible member 56 which tends to wear out and deteriorate after extended use.

Figure 6:
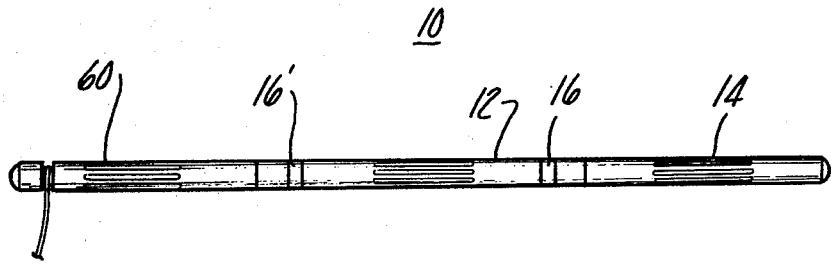
FIG. 6 is a plan view illustrating a modification of the weapon of the present invention as a night stick.
Figure 7:
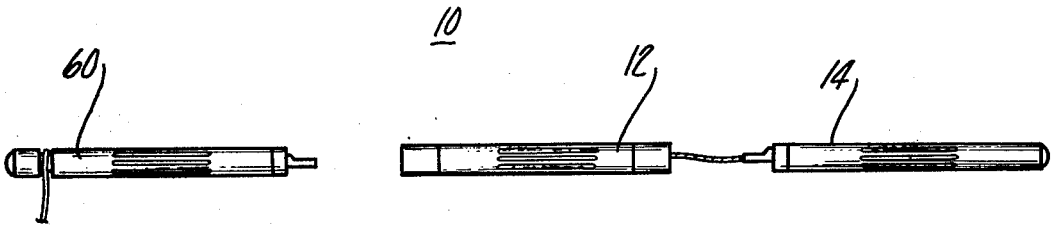
FIG. 7 is a plan view of the modification of the weapon of the present invention illustrated in FIG. 6, but illustrating the weapon as a nunchaku.

With reference now to FIGS. 6 and 7, a modification of the weapon 10 of the present invention is there shown in which an additional handle member 60 is detachably secured to the outer axial end of the handle member 12 by means of a coupling 16'. The coupling 16' can be substantially identical to the coupling 16 with the exception that the flexible member 56 is eliminated. Consequently, the handle portion 60 is entirely detachable from the handle member 12.

With the modification of the weapon 10 of the present invention illustrated in FIGS. 6 and 7, an elongated night stick (FIG. 6) can be obtained. Alternatively, as shown in FIG. 7, a nunchaku is also obtained while the additional handle member 60 forms a relatively short billy club.

While the coupling 16 of the present invention has been described in great detail, it is to be understood, of course, that any appropriate detachable coupling can be used for axially securing the handle members 12 and 14 together while remaining within the scope of the invention. As such, no unnecessary limitations, other than set forth in the appended claims, shall be drawn from this disclosure.

Figure 8:
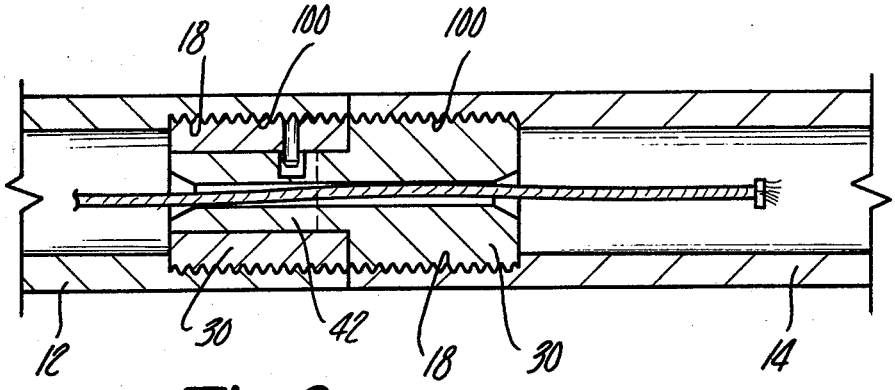
FIG. 8 is a sectional view similar to FIG. 2 but showing a modification thereof.

For example, a modified coupling is illustrated in FIG. 8 in which the cylindrical recess 18 in each handle member 12 and 14 includes internal threads 100 which threadably receive one of the shanks 30. In addition, the enlarged head 34 on both the male and female portions is eliminated so that the inner axial ends of the handle members 12 and 14 abut against each other. In this manner the coupling 16 is effectively hidden from view.

The weapon 10 of the present invention thus provides a novel combination night stick and nunchaku which can easily be converted from a night stick to a nonchaku and vice versa. Moreover, this conversion can be easily and rapidly achieved.

Having thus described my invention, many modifications thereto will become apparent to those skilled in the art to which the invention pertains without deviating from the spirit of the invention as defined by the scope of the appended claims.

I claim:

1. A combination nunchaku and night stick weapon comprising a first elongated member having a first and second axial end, a second elongated member having a first and second axial end, means for detachably securing the first end of said first member to the first end of said second member so that said members are coaxially secured together to form a night stick, said detachable securing means further comprising a female portion secured to the first end of the first member, a male portion secured to the first end of the second member, said male portion having an axially outwardly extending shank which is axially slidably received in a recess in said female portion, means for coaxially locking said male and female portions together upon rotation of one member relative to the other, and a flexible means extending between said members, means for retaining one end of said flexible means to one member and the other end of the flexible means to the other member, said flexible means being sufficiently long to permit axial separation of the members whereupon the weapon is a nunchaku.

2. The invention as defined in claim 1 wherein said flexible means is a cable.

3. The invention as defined in claim 1 and including means for detachably securing said male and female portions to their respective members.

4. The invention as defined in claim 3 wherein said last mentioned means comprises a pair of internally threaded sleeves, one sleeve being secured within a recess formed in each of said members, each of said sleeves being adapted to threadably receive a threaded shank on one of said portions.

5. The invention as defined in claim 1 and including a third elongated member and means for detachably coaxially securing one end of said third member to the second end of one of said members.

6. The invention as defined in claim 1 wherein said means for attaching said flexible means to said members further comprises means for permitting free axial rotation of said members relative to said flexible means, one end of said flexible means extending through a bore in the female portion and the other end of the flexible means extending through a bore in the male portion, said bores being larger in size than said flexible means, and said retaining means including an end stop secured to each end of the flexible means.

7. The invention as defined in claim 1 wherein said shank and said recess are substantially circular in cross-sectional shape and wherein said locking means further comprises a pin secured to the female portion and extending substantially radially inwardly into the female portin recess, said pin being spaced away from an axially extending flat formed on the male portion shank to permit the insertion of the shank into the recess, said pin being in registration with a circumferential slot formed on the shank when the shank is inserted into the recess whereby rotation of one member relative to the other moves said pin, into said slot to thereby prevent axial separation of the members.

8. The invention as defined in claim 1 wherein each member includes a handle portion adjacent the second end thereof, each handle portion further comprising a plurality of circumferentially spaced and axially extending grooves about the outer periphery of the elongated members.

* * * * *

UNITED STATES PATENT AND TRADEMARK OFFICE

CERTIFICATE OF CORRECTION

PATENT NO. : 4,132,408
DATED : January 2, 1979
INVENTOR(S) : Jack M. Sabat

It is certified that error appears in the above-identified patent and that said Letters Patent are hereby corrected as shown below:

In the Abstract, line 10, after couplings delete "." and insert --,-- therefor;

Column 1, line 5, delete "Inventio" and insert --Invention-- therefor;

Column 1, line 47, delete "woood" and insert --wood-- therefor;

Column 3, line 26, delete "te" and insert --the-- therefor;

Column 3, line 32, delete "th" and insert --the-- therefor;

Column 3, line 33, delete "portin" and insert --portion-- therefor;

Column 3, line 56, delete "ae" and insert --are-- therefor;

Column 3, line 68, delete "ad" and insert --and--

Signed and Sealed this

*Third* Day of *April 1979*

[SEAL]

*Attest:*

RUTH C. MASON
*Attesting Officer*

DONALD W. BANNER
*Commissioner of Patents and Trademarks*